US006733195B2

(12) United States Patent
Shirotori et al.

(10) Patent No.: US 6,733,195 B2
(45) Date of Patent: May 11, 2004

(54) HEAD DRIVE CIRCUIT FOR IMPACT DOT PRINTER

(75) Inventors: Hiroshi Shirotori, Nagano (JP); Hisashi Watamura, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 226 days.

(21) Appl. No.: 09/954,007

(22) Filed: Sep. 18, 2001

(65) Prior Publication Data

US 2002/0057936 A1 May 16, 2002

Related U.S. Application Data

(63) Continuation-in-part of application No. 09/693,991, filed on Oct. 23, 2000, now Pat. No. 6,659,663.

(30) Foreign Application Priority Data

| | | |
|---|---|---|
| Oct. 22, 1999 | (JP) | P11-301775 |
| Apr. 24, 2000 | (JP) | P2000-122554 |
| Apr. 24, 2000 | (JP) | P2000-123099 |
| Sep. 18, 2000 | (JP) | P2000-281804 |

(51) Int. Cl.[7] ..... B41J 2/25
(52) U.S. Cl. ..... 400/124.01; 400/124.16
(58) Field of Search ..... 400/124.01, 124.03, 400/124.05, 124.11, 124.18, 157.2, 157.3, 118.3, 124.16

(56) References Cited

U.S. PATENT DOCUMENTS

| | | | | |
|---|---|---|---|---|
| 4,428,693 A | * | 1/1984 | Bovio et al. | 347/37 |
| 4,454,558 A | * | 6/1984 | Huddart | 361/153 |
| 4,637,742 A | * | 1/1987 | Sakai | 400/124.02 |
| 4,764,858 A | * | 8/1988 | Valenti | 363/89 |
| 4,850,724 A | * | 7/1989 | Fattori | 400/157.2 |
| 5,099,383 A | * | 3/1992 | Fukano et al. | 361/153 |
| 5,325,228 A | * | 6/1994 | Matsubara et al. | 359/249 |

FOREIGN PATENT DOCUMENTS

| | | |
|---|---|---|
| EP | 0 373 870 A2 | 6/1990 |
| EP | 0 472 407 A1 | 2/1992 |
| JP | 58-219070 | 12/1983 |
| JP | 58-219070 A | 12/1983 |
| JP | 3-51140 | 3/1991 |

* cited by examiner

*Primary Examiner*—Anthony H. Nguyen
(74) *Attorney, Agent, or Firm*—Sughrue Mion, PLLC

(57) ABSTRACT

In a head drive circuit for an impact dot printer which performs printing by driving a print wire, a DC power source supplies a power source voltage. A switching element is on/off controlled to apply the power source voltage to a head coil for a predetermined time period. A voltage regulator converts an input voltage having a value higher than the power source voltage into an output voltage having a value as substantially same as the power source voltage. A voltage introducer inputs an inductive voltage, generated in the head coil when the switching element is turned off, into the voltage regulator as the input voltage. A voltage returner feeds back the output voltage of the voltage regulator to the DC power source.

5 Claims, 12 Drawing Sheets

FIG. 5A
FIG. 5B
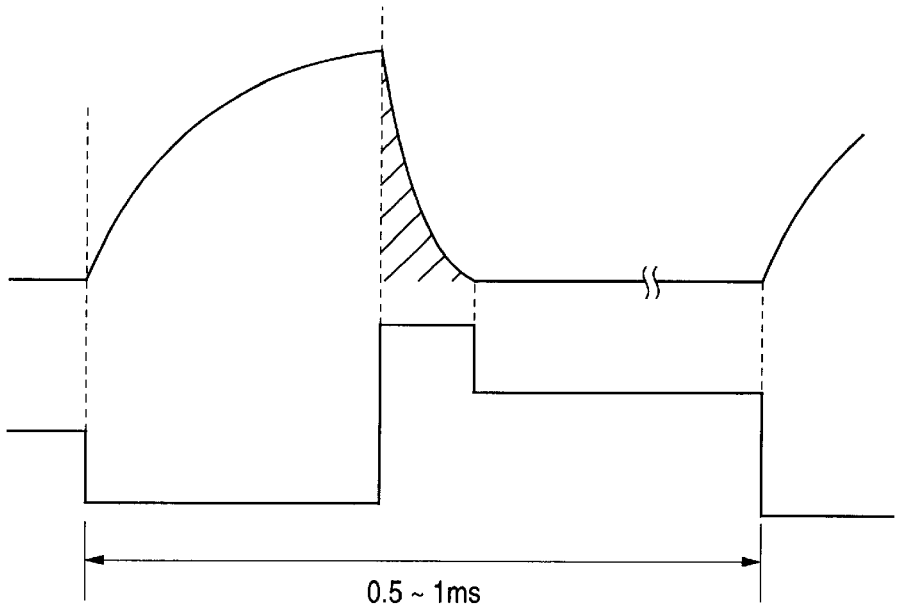
FIG. 5C
FIG. 5D
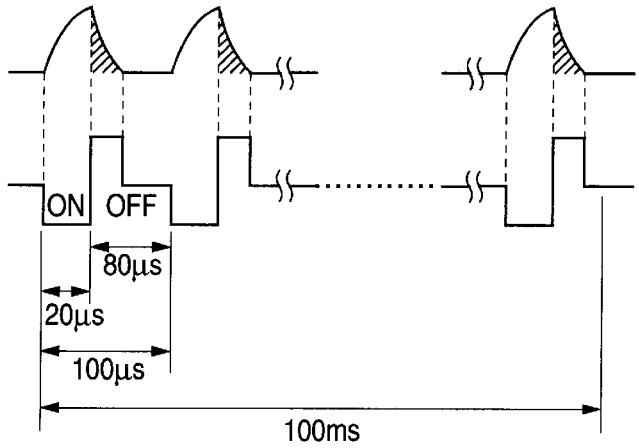

HEAD DRIVE CIRCUIT FOR IMPACT DOT PRINTER

CROSS-REFERENCE TO RELATED APPLICATION

This is a continuation-in-part application of U.S. patent application Ser. No. 09/693,991 filed on Oct. 23, 2000, now U.S. Pat. No. 6,659,663.

BACKGROUND OF THE INVENTION

The present invention relates to an impact dot printer, and more specifically, relates to a circuit for driving a head of an impact dot printer and to a power control technique for controlling a power source for a head drive circuit.

To perform printing, an impact dot printer drives a print wire by using, for example, the magnetic attractive force of an electromagnet. FIG. 13 is a diagram showing an example wire impact print head for the print head of the thus arranged impact dot printer.

In the example in FIG. 13, a wire impact print head 51 has a plurality of wires 57 that are attached, by wire levers 53 and return springs 55, so that they reciprocate. When a drive current flows through a head coil 59, a wire lever 53 is attracted by the magnetic attractive force produced by the electromagnet in the direction indicated by an arrow in FIG. 13, and a wire 57 strikes an ink ribbon 61 and forms dots on a printing sheet 65 moved in consonance with the rotation of a platen 63.

FIG. 14 is a diagram illustrating the fundamental structure of the circuit of the print head 51 for driving the head coil 59. In this example, only one head coil 59 and head driving transistor 33 set is shown, but in actuality, a plurality of these sets are provided. A drive circuit (driver) 30 for each head coil 59 is constituted by one of the head driving transistors 33, a head drive power source 34 and a Zener diode 35. During a predetermined conductive period, a control pulse 32 is maintained at level H by a print controller 31, and a pertinent head driving transistor 33 is maintained in the ON state (in the saturated region). Then, a voltage (e.g., 35V) supplied by the head drive power source 34 is applied to the head coil 59, and a drive current i1 flows through it. Thereafter, when the control pulse 32 falls to level L, the head coil 59 generates an inductive electromotive force to render off the head driving transistor 33. For this, the Zener diode 35 is rendered conductive at the induced voltage, and a base current flows to the head driving transistor 33, while the head driving transistor 33 enters a linear operating region. Subsequently, the drive current i1 flows through the head driving transistor 33 and the current value is drastically reduced, and as a result, the head driving transistor 33 is rendered off.

However, in the related head drive circuit, when the head driving transistor is turned off, the power supplied by the head drive power source is not effectively employed. This problem will be described while referring to FIGS. 15A to 15D. In these drawings are presented a diagram showing a simplified head drive circuit, and other diagrams showing the flow of the drive current, as well as its current waveform and the operation of the Zener diode.

First, as is shown in FIG. 15A, when the transistor is rendered on, a drive current i is supplied by a power source Vp in the direction indicated by the arrow, and a head coil is driven. At this time, the collector-emitter voltage ($V_{CE}$) of the transistor is substantially zero.

To render off the transistor, when the inductive electromotive force that is generated at the coil at the polarities shown in FIG. 15A exceeds the Zener voltage, the Zener diode is rendered conductive, and a base current flows via the Zener diode to the transistor, as is indicated by a broken line in FIG. 15A. Then, the charge on the transistor falls in the linear operation mode, and the energy accumulated in the coil is discharged through the collector and the emitter of the transistor. When the discharge of the energy has been completed, the Zener diode is again rendered non-conductive and the transistor is rendered off.

FIGS. 15B and 15C are graphs showing the changes produced by this process in the collector current i and the collector-emitter voltage ($V_{CE}$) of the transistor as time elapses. As a result, as is shown in FIG. 15D, of the power (see FIG. 15B) supplied by the power source, power P ($=i \cdot V_{CE}$), which is required to render off the transistor, is consumed for heat generation at the transistor as thermal loss represented by Q in the figure.

As is described above, in the related head drive circuit, the power supplied by the power source to render off the transistor is lost and is not effectively employed. Furthermore, since a great deal of heat is generated by the transistor, a cooling member, such as a heat sink, is also required, and accordingly, the size of the package of a power source is enlarged.

SUMMARY OF THE INVENTION

To resolve these shortcomings, it is one objective of the present invention to provide a head drive circuit that not only drives the head efficiently, but also reduces the consumption of power, and to produce a compact power source.

To achieve the above objective, according to the present invention, there is provided a head drive circuit for an impact dot printer which performs printing by driving a print wire, comprising:

a DC power source for supplying a power source voltage;

a head coil;

a switching element which is on/off controlled to apply the power source voltage to the head coil for a predetermined time period;

a voltage regulator for converting an input voltage having a value higher than the power source voltage into an output voltage having a value as substantially same as the power source voltage;

a voltage introducer for inputting an inductive voltage, generated in the head coil when the switching element is turned off, into the voltage regulator as the input voltage; and a voltage returner for feeding back the output voltage of the voltage regulator to the DC power source.

Namely, the head drive circuit is so configured that the voltage regulator returns to the power source the power that accumulates when the switching element (e.g., a transistor) is rendered off.

With this arrangement, the energy that accumulates in the head coil when the switching element is turned off is returned to the power source by the voltage regulator, and is effectively utilized for driving the head coil.

A DC/DC converter or a voltage dropper may be adopted as the voltage regulator.

Preferably, the voltage introducer includes a first rectifier which is rendered conductive when the inductive voltage is generated in the head coil to unidirectionally supply the inductive voltage into the voltage regulator as the input voltage, and the voltage returner includes a second rectifier for unidirectionally supplying the output voltage from the voltage regulator to the DC power source. For example, diodes may be adopted as the rectifiers.

Since the rectifiers (e.g., diodes) required for the prevention of a crosscurrent are provided, the backflow of power, from the input end of the voltage regulator to the switching element, or the inverted supply of power, from the power source to the output end of the voltage regulator, can be prevented.

Preferably, the head drive circuit further comprises an input voltage adjuster for adjusting the input voltage of the voltage regulator so as to have a predetermined value higher than the power source voltage. Specifically, so long as the input voltage of the voltage regulator is raised to a predetermined voltage that only when the switching element is rendered off is higher than the voltage provided by the power source, the power from the head coil can be led to the voltage regulator and can thereafter be returned to the power source by a high induction voltage that is generated at the head coil.

Preferably, the voltage regulator includes an input condenser for smoothing the input voltage thereof. The voltage adjuster includes a charger for charging the input condenser so as to have the predetermined value of input voltage before and while the printing is performed.

Preferably, the charger always applies the predetermined value of voltage to the input condenser.

Alternatively, the switching element is turned on/off repeatedly at a frequency too high to drive the print wire to apply the inductive voltage to the input condenser repeatedly at least before the printing is performed, thereby the switching element and the head coil serve as the charger.

Alternatively, the charging operation using the switching element and the head coil may be used not only for the initial charging performed before the printing is started, but may also be used, as needed, during the printing operation (e.g., following a line return) to supplement the discharging of the condenser.

Alternatively, the charger includes: a charge coil; a coil switching element which is on/off controlled to apply the power source voltage to the charge coil; and an input voltage holder for inputting an inductive voltage, generated in the charge coil when the coil switching element is turned off, to the input condenser. The coil switching element is turned on/off repeatedly to apply the inductive voltage generated in the charge coil to the input condenser repeatedly at least while the printing is performed, thereby the charged voltage in the input condenser is maintained at the predetermined value.

Alternatively, the input voltage holder may be employed not only for supplementary charging during the printing, but also for the initial charging performed before printing is begun.

Preferably, the head drive circuit further comprises a charger, which performs a first charging operation in which a condenser provided with the voltage regulator is initially charged when the DC power source is turned on, and a second charging operation in which the condenser is supplementally charged while the DC power source is turned on. Here, the condenser smoothes the input voltage of the voltage regulator.

Here, it is preferable that the head drive circuit further comprises a power saving mode in which the DC power source is temporarily turned off even though a main power for the impact dot printer is turned on. Here, the charger charges the condenser when the main power is turned on, and when the power saving mode is deactivated while the main power is turned on.

Further, it is preferable that the charger turns on/off the switching element repetitively at a frequency which is too high to drive the print wire, so that an inductive voltage generated in the head coil is charged to the condenser every time when the switching element is turned off, in the first charging operation.

Still further, it is preferable that the charger includes: a charging coil; a coil switching element which determines whether the power source voltage of the DC power source is supplied to the charging coil; and an input voltage holder which applies an inductive voltage generated in the charging coil when the coil switching element is turned off to the condenser. Here, the charger turns on/off the coil switching element repetitively, so that the inductive voltage generated in the charging coil is repetitively charged to the condenser every time when the coil switching element is turned off, in the second charging operation.

Preferably, the charger performs the second charging operation periodically.

BRIEF DESCRIPTION OF THE DRAWINGS

The above objects and advantages of the present invention will become more apparent by describing in detail preferred exemplary embodiments thereof with reference to the accompanying drawings, wherein like reference numerals designate like or corresponding parts throughout the several views, and wherein:

FIG. 3B being a waveform graph for a drive current that flows through a head coil; FIG. 3C being a waveform graph for the collector-emitter voltage of a head driving transistor; and FIG. 3D being a graph showing power loss of the head driving transistor;

FIGS. 5A to 5D are waveform graphs for the printing and for the initial charging according to the second embodiment, with FIG. 5A showing the waveform of a current that flows through a head coil during printing; FIG. 5B showing the waveform of the collector-emitter voltage of a head driving transistor during printing; FIG. 5C showing the waveform of a charge current that flows through the head coil during the initial charging; and FIG. 5D showing the waveform of the collector-emitter voltage of the head driving transistor during the initial charging;

FIG. 10B being a waveform graph for a drive current that flows through a head coil; FIG. 10C being a waveform graph for the collector-emitter voltage of a head driving transistor; and FIG. 10D being a graph showing power loss of the head driving transistor;

FIG. 15B being a waveform graph for a drive current that flows through a head coil; FIG. 15C being a waveform graph for the base-emitter voltage of a head driving transistor; and FIG. 15D being a graph showing the power loss for the head driving transistor.

DETAILED DESCRIPTION OF THE PREFERRED EMBODIMENTS

Figure 1:
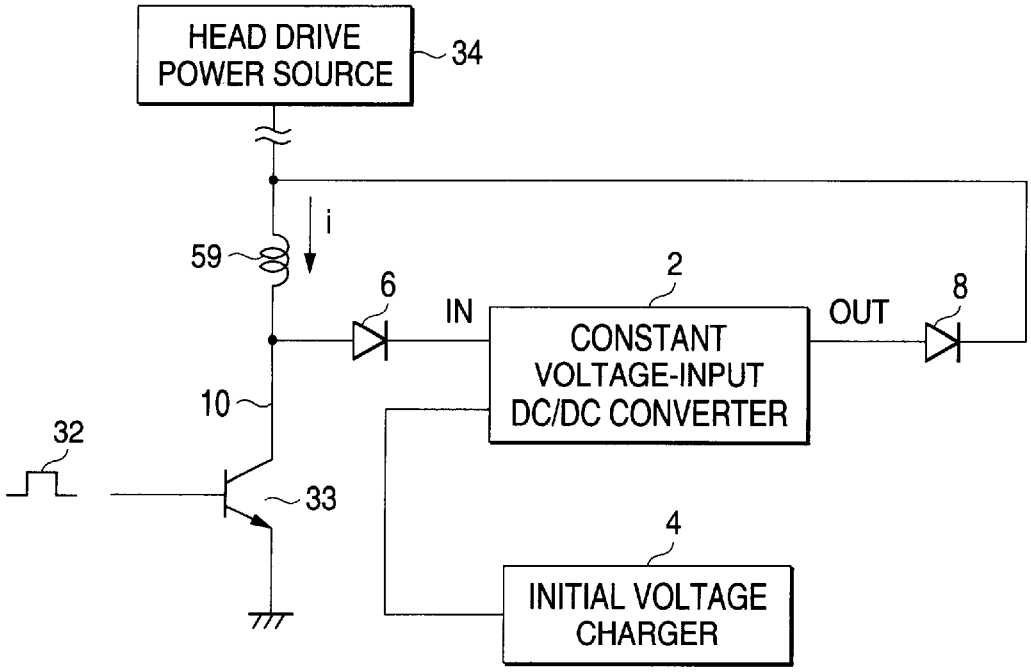
FIG. 1 is a diagram showing the arrangement of a head drive circuit according to a first embodiment of the invention.

The preferred embodiments of the present invention will now be described while referring to the accompanying drawings. FIG. 1 is a diagram showing the arrangement of a head drive circuit according to a first embodiment of the present invention.

As is shown in FIG. 1, the head drive circuit comprises: a head driving transistor 33, for driving a head coil 59; a constant voltage-input DC/DC converter 2, which has an input voltage of 90V and an output voltage of 35V that is equivalent to that of a head drive power source 34; an initial voltage charger 4, for raising the voltage input by the constant voltage-input DC/DC converter 2 to 90V; a diode 6 (a first rectifier) the anode of which is connected to the head coil 59 and a collector 10 of the head driving transistor 33 and the cathode of which is connected to the input end of the constant voltage-input DC/DC converter 2; and a diode 8 (a second rectifier) the anode of which is connected to the output end of the constant input DC/DC converter 2 and the cathode of which is connected to the head drive power source 34. A related Zener diode, which connects the head coil 59 and the base of the head driving transistor 33, is not provided for the head drive circuit of this embodiment. And the operation of the constant voltage-input DC/DC converter 2 is so controlled that the input voltage is 90V and the output voltage is equal to a voltage, such as 35V, obtained by adding the voltage drop at the diode 8 of the head drive power source 34.

Before a print head actually begins printing, the initial voltage charger 4 sets a voltage of 90V as the input voltage for the constant voltage-input DC/DC converter 2 (the charge voltage for a smoothing condenser 2*a* in FIG. 2, which will be described later, that is provided at the input end of the DC/DC converter 2). When the head driving transistor 33 is rendered on, a drive current supplied by the head drive power source 34 drives the head coil 59. When the head driving transistor 33 is rendered off, an induced electromotive force is generated at the head coil 59, so that a high voltage is produced at the collector 10 of the head driving transistor 33 and is clamped at the 90V input voltage of the DC/DC converter 2. The drive current i is absorbed by the constant voltage-input DC/DC converter 2, is returned, via the diode 8, from the output end of the DC/DC converter 2 to the head drive power source 34, and is employed again.

Figure 2:
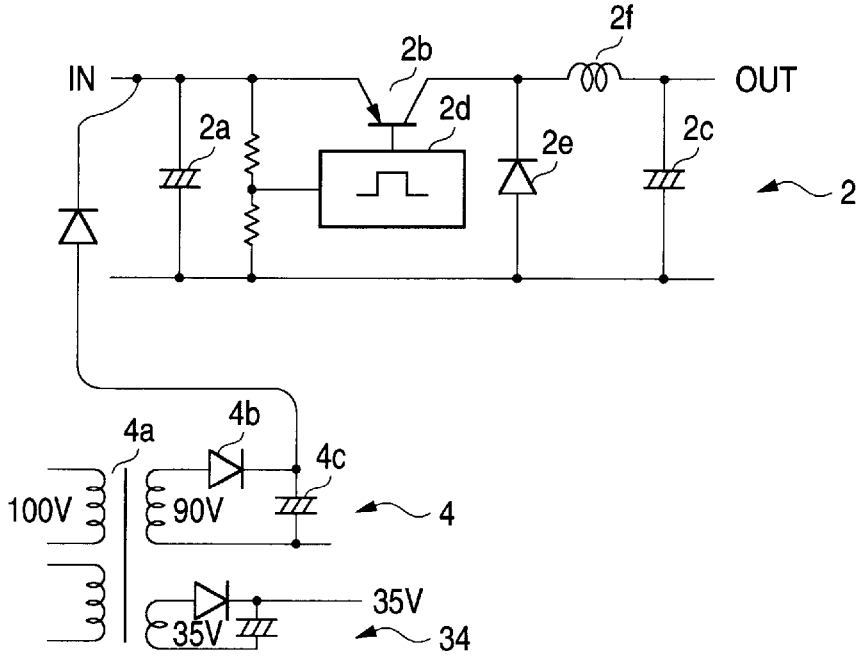
FIG. 2 is a circuit diagram showing a constant voltage-input DC/DC converter and an initial voltage charger according to the first embodiment.

FIG. 2 is a circuit diagram showing the constant voltage-input DC/DC converter 2 and the initial voltage charger 4. The constant voltage-input DC/DC converter 2 employs a drive controller 2*d* to switch a chopper transistor 2*b* in order to control a duty ratio. Therefore, the 90V input voltage of the DC/DC converter 2 is chopped, and on the output side, the obtained voltage waveform is smoothed and reduced by a condenser 2*c* to provide a constant 35V output, while a feedback diode 2*e* feeds the energy accumulated at a DC reactor 2*f* back to the condenser 2*c* when the transistor 2*b* is rendered off. In the initial voltage charger 4, a transformer 4*a* reduces an AC voltage of 100V, received from a commercially available power source, to an AC voltage of 90V. The AC voltage of 90V is rectified by a diode 4*b*, and the obtained voltage is smoothed by a condenser 4*c* to provide a DC voltage of 90V that is applied to the input end of the constant voltage-input DC/DC converter 2. As a result, a constant voltage-input of 90V is maintained for the input voltage DC/DC converter 2.

In addition to the chopper system in FIG. 2 that uses a constant voltage control amplifier, various other configurations, such as a ringing choke converter, may be employed for the constant input DC/DC converter 2. Furthermore, the initial voltage charger 4 is not limited to the arrangement shown in FIG. 2.

FIGS. 3A to 3D are diagrams showing a simplified circuit for the head drive circuit according to this embodiment, and graphs showing the flow of a drive current and its current waveform. The operation of the head drive circuit of this embodiment will now be explained while referring to FIGS. 3A to 3D.

While, as is indicated by a chained line in FIG. 3A, it is natural for a pair of the head coil 59 and the head driving transistor 33 to be provided for each of multiple print wires, the processing will be explained for the pair of the head coil 59 and the head driving transistor 33 for one print wire. First, when the head driving transistor 33 is rendered on, the drive current i, which is supplied by the power source Vp in the direction indicated by an arrow, and the power P shown in FIG. 3B is supplied to and drives the head coil 59.

Figure 3A:
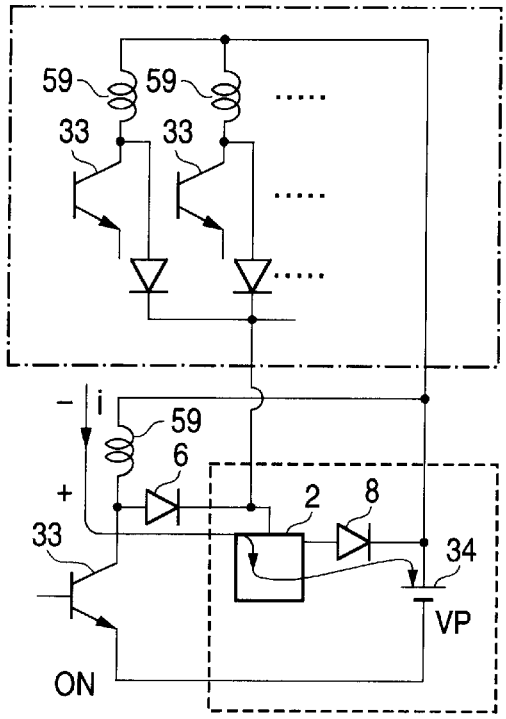
FIGS. 3A to 3D are diagrams for explaining the operation of the head drive circuit according to the first embodiment, with FIG. 3A being a simplified circuit diagram for the head drive circuit.
Figure 3B:
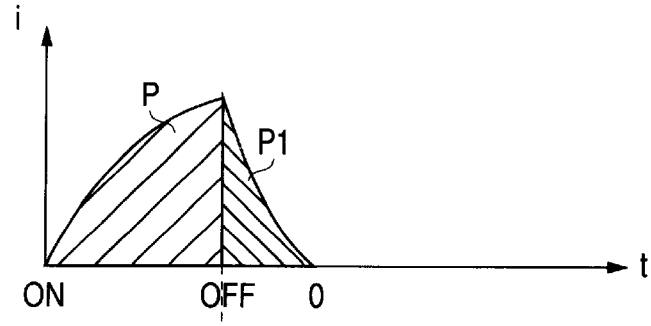
Figure 3C:
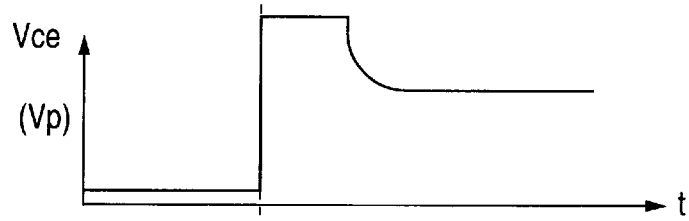
Figure 3D:
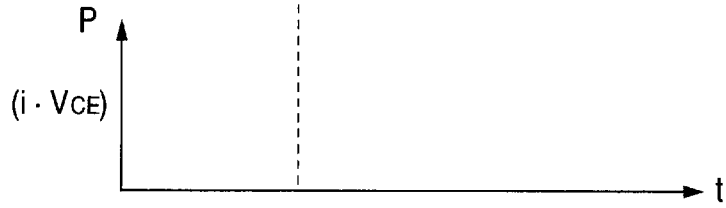

Then, when the head driving transistor 33 is rendered off, an induced electromotive force, having the polarities shown in FIG. 3A, is generated at the head coil 59, and the diode 6 is rendered conductive by the application of the high, induced voltage. Thus, as is shown in FIG. 3C, the collector voltage at the head driving transistor 33 is clamped at the 90V input voltage provided by the DC/DC converter 2, and as is indicated by the arrow in FIG. 3A, the drive current i flows via the diode 6 to the input end of the constant voltage-input DC/DC converter 2. In this manner, the current that is supplied to the head coils 59 of the multiple print wires when they are turned off is absorbed by the input end of the constant voltage-input DC/DC converter 2. The absorbed current is thereafter transformed by the constant voltage-input DC/DC converter 2 to provide a DC current having substantially the same voltage as the voltage Vp provided by the head drive power source 34, and the obtained DC current is transmitted, via the diode 8, from the output end of the DC/DC converter 2 to the head drive power source 34. Therefore, since the head driving transistor 33 can be immediately and completely rendered off, and since the current that flows through the head driving transistor 33 is substantially zero, as is shown in FIG. 3D there is no substantial power loss at the head driving transistor 33. That is, as is indicated by the right-down hatching in FIG. 3B, according to this embodiment, the power P1 that is to be wasted in the related circuit when the head driving transistor 33 is rendered off can be returned to the power source 34 and employed again as head driving energy. The heat generated by the transistor 33 is also reduced considerably, so that only a simple cooling countermeasure is required and the size of a power source package can be reduced.

In this embodiment, the head coil and the driving transistor are constituted at one stage. The arrangement, however, is not limited to this one, and driving transistors may, for example, be provided in both the upper and lower stages and employed for the respective upper and lower head coils. For this circuit structure, the waveform of the drive current would differ from that shown in FIG. 3B; however, also in such a configuration, the energy wasted when the transistor is in the OFF state can be returned to the head drive power source and employed again.

Figure 4:
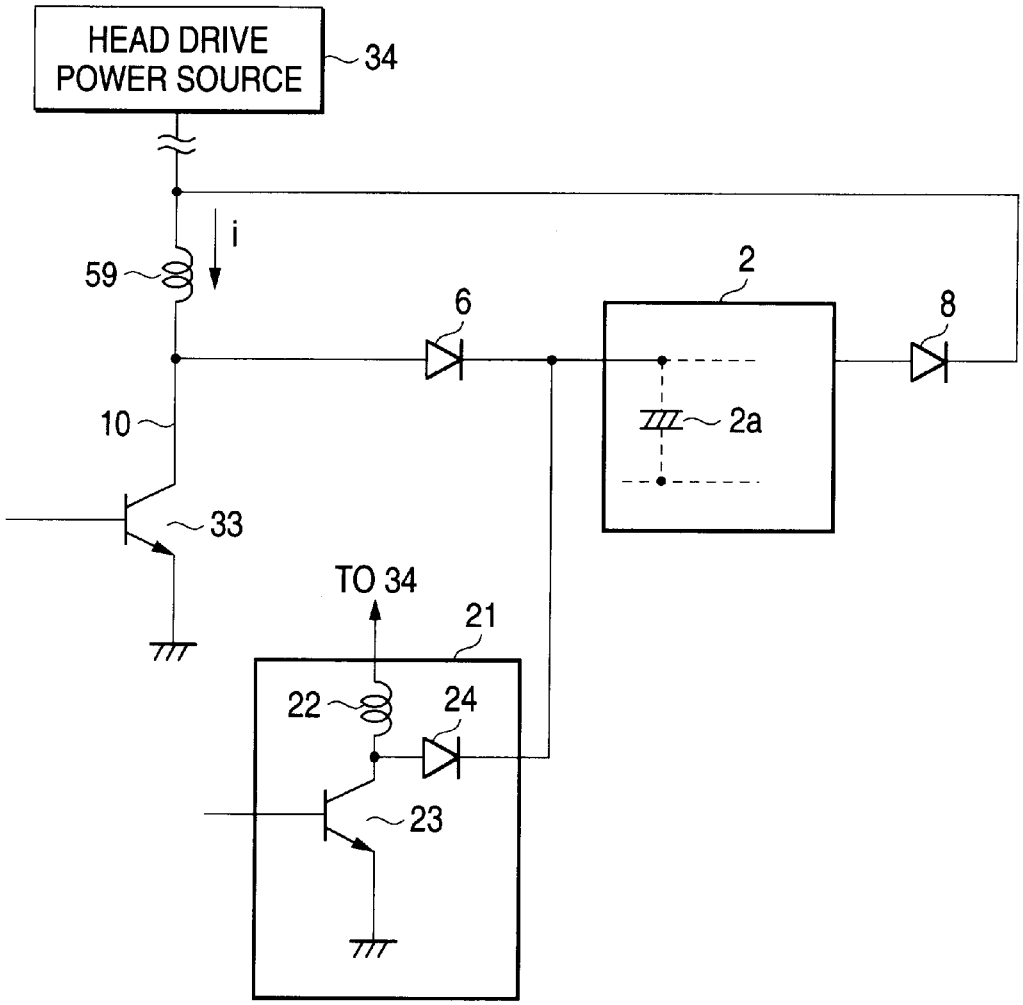
FIG. 4 is a diagram showing the arrangement of a head drive circuit according to a second embodiment of the invention.

A second embodiment of the present invention will now be described while referring to the drawings. FIG. 4 is a diagram showing the arrangement of a head drive circuit according to a second embodiment of the present invention. The head drive circuit differs from the circuit for the first embodiment in FIG. 1, in that the initial voltage charger 4 is replaced with an input voltage holder 21. In the input voltage holder 21, a charge coil 22, a child driving transistor 23 and a diode 24 are connected in the same manner as are a head coil 59, a head driving transistor 33 and a diode 6 that together constitute the print wire drive circuit; however, the current capacity is smaller than that of the print wire drive circuit. Before printing is initiated, the head coil 59 and the head driving transistor 33, which constitute the print wire drive circuit, are repetitiously and rapidly driven at short intervals, so that an initial charge is placed on a condenser 2*a* (hereinafter referred to simply as a condenser 2*a*) on the input side of the constant voltage-input DC/DC converter 2. After printing is begun, the input voltage holder 21 is driven as needed to place supplemental charges on the condenser 2*a*, so that a reduction in the input voltage due to the discharging of the condenser 2*a* can be prevented.

The processing performed for the second embodiment will now be described. However, since the same process as in the first embodiment is performed when the constant voltage-input DC/DC converter 2 absorbs the energy accumulated by the head coil 59 at the time the head driving transistor 22 is rendered off and subsequently returns the energy to the power source 34, no further explanation for this process will be given.

First, when a printer is powered on, before printing is initiated the initial charging is performed, at a predetermined time, for the constant voltage-input DC/DC converter 2. At this time, the print wire in the head is repeatedly and rapidly driven by pulses, emitted by the print wire drive circuit, that are short enough to prevent the print wire from actually being operated. That is, ON/OFF pulses emitted at such a high frequency that they do not drive the print wire are transmitted to the base-emitter of the head driving transistor 33. Thus, the head driving transistor 33 is repetitively and rapidly rendered on and off, while the head coil 59 accumulates from the power source 34 energy that is transmitted to and is used to place a charge on the condenser 2*a* of the DC/DC converter 2. This process is repeated until the condenser 2*a* is charged to 90V. Thereafter, the normal printing operation is begun.

Since the charge voltage on the condenser 2*a* gradually drops during printing, periodically, or as needed, e.g., each time the printing of one line is completed or each time a string of 40 characters has been printed, at the same high pulse as is employed for the initial charging, the input voltage holder 21 is rapidly and repetitiously turned on and off during a specific period. In this manner, supplemental charging of the condenser 2*a* is performed, and the charge voltage held by the condenser 2*a* is maintained substantially at the 90V level.

As is shown in FIG. 4, the input voltage holder 21 includes: the charge coil 22; the coil driving transistor 23, which drives the charge coil 22; and a diode 24, which is rendered conductive by the inductive electromotive force that is generated at the charge coil 22 when the coil driving transistor 23 is turned off and which transmits a current to the input end of the DC/DC converter 2. The supplemental charging process for the input voltage holder 21 is exactly the same as the initial charging process performed for the print wire drive circuit. That is, each time the transistor 23 is rendered on, energy is accumulated by the charging coil 22, and each time the transistor 23 is rendered off, the accumulated energy is transmitted, via the diode 24, to the condenser 2*a*. When this operation is repeated over a predetermined period of time, the voltage held by the condenser 2*a* is supplemented, and is maintained at the 90V level. The charge current used for the supplemental charging may be smaller than the charge current that is required for the initial charging, so that the current capacity of the input voltage holder 21 may be smaller than that of the print wire drive circuit.

The initial charging operation will be described in more detail while referring to a waveform diagram in FIGS. 5A to 5D. FIGS. 5A and 5B are diagrams showing the waveform of the print wire drive circuit during printing. The waveform of the current that flows through the head coil 59 is shown in FIG. 5A, while the waveform of the collector-emitter voltage of the head driving transistor 33 is shown in FIG. 5B. FIGS. 5C and 5D are diagrams showing the waveforms of the print wire drive circuit during the initial charging. The waveform of the initial charge current that flows through the head coil 59 is shown in FIG. 5C, while the waveform of the base-emitter voltage at the head driving transistor 33 is shown in FIG. 5D.

During the printing operation, the head driving transistor 33 is driven by a pulse having a frequency of substantially 1 to 2 kHz, as is shown in FIG. 5B. Then, the current shown in FIG. 5A flows to the head coil 59 and the print wire is driven. For the initial charging, the head driving transistor 33 is repetitively, about 1000 times, rendered on and off, for about 100 ms, using a pulse having a frequency of about 10 kHz, as shown in FIG. 5D (e.g., an ON time width of 20 $\mu$s and an OFF time width of 80 $\mu$s). As a result, a tiny pulse current having the short time width shown in FIG. 5C is repetitively supplied to the head coil 59; however, such a tiny current at such a high frequency does not drive the print wire. Of the tiny current pulses, the current in the portions wherein the head driving transistor 33 has been rendered off (e.g., the current in the shaded portions in FIG. 5C) flows, via the diode 24, as a charge current to the condenser 2*a* of the constant voltage-input DC/DC converter 2. When, through this switching, during a 100 ms period the charge current is repetitively supplied 1000 times, the charge voltage held by the condenser 2*a* is increased until it is substantially 90V.

The supplemental charging, which is performed during the printing process by the input voltage holder 21, can be effected by rendering on and off the coil driving transistor 23 at a pulse having the same frequency as that employed for the initial charging, or at a pulse having a higher frequency. For the supplemental charging, for example, a charge inductance 22 of 3300 $\mu$H is employed to drive the coil driving transistor 23 following each line return at a pulse having a frequency of 25 kHz and an ON time of 3 $\mu$s.

As is described above, since the input voltage holder 21 only performs supplemental charging, its current capacity is smaller than that of the wire drive circuit. As a modification, the current capacity of the input voltage holder 21 may be increased to that of the print wire drive circuit, so that the input voltage holder 21 can also perform the pre-printing initial charging. Or instead, the printing wire drive circuit and the input voltage holder 21 may together be employed to perform the initial charging.

As another modification, the supplemental charging may be performed by the print wire drive circuit, without the input voltage holder 21 being provided. For the supplemental charging, for example, following each line return the print wire drive circuit need only be driven at a pulse having as high a frequency as the one used for the initial charging (only a few driving operations are required, compared with the number that is needed for the initial charging).

Figure 6:
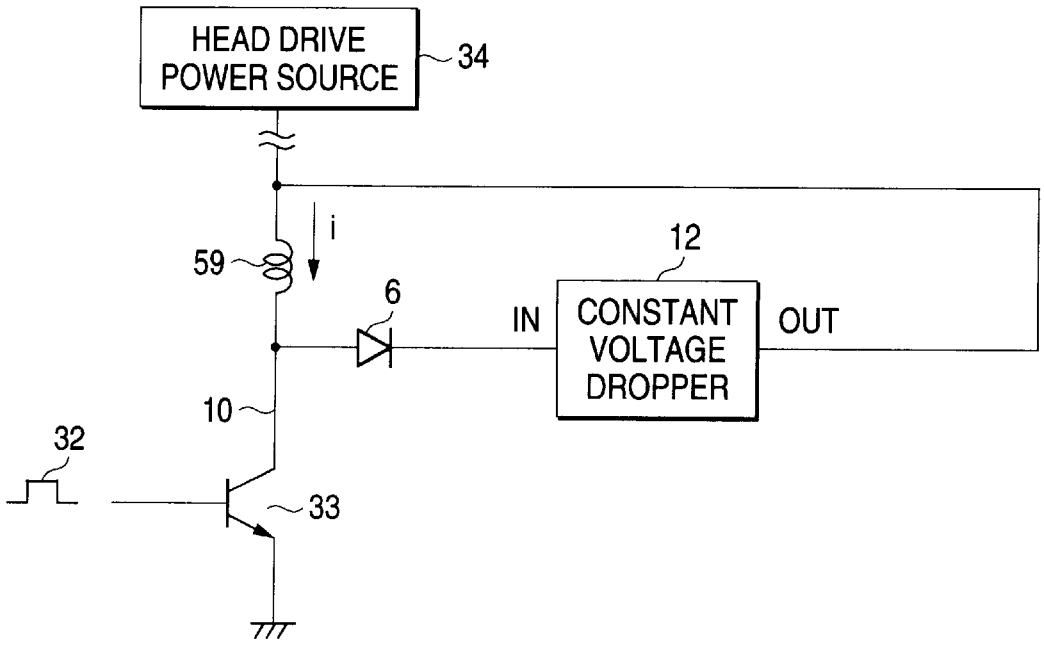
FIG. 6 is a diagram showing the arrangement of a head driving circuit according to a third embodiment of the invention.

A third embodiment of the present invention will now be described while referring to the drawings. FIG. 6 is a diagram showing the arrangement of a head drive circuit according to a third embodiment of the present invention. The head drive circuit differs from the circuit for the first embodiment shown in FIG. 6, in that the constant voltage-input DC/DC converter 2 and the initial voltage charger 4 are replaced with a constant voltage dropper 12.

As is shown in FIG. 6, the head driving circuit comprises: a head driver transistor 33, for driving a head coil 59; a constant voltage dropper 12, which reduces, to a predetermined voltage value, an induction voltage that is generated at the head coil 59 when the head driver transistor 33 is turned off and which returns the obtained voltage to a head driving power source 34; and a diode 6, the anode of which is connected to the head coil 59 and a collector 10 of the head driver transistor 33 and the cathode of which is connected to the input end of the constant voltage dropper 12.

Figure 7:
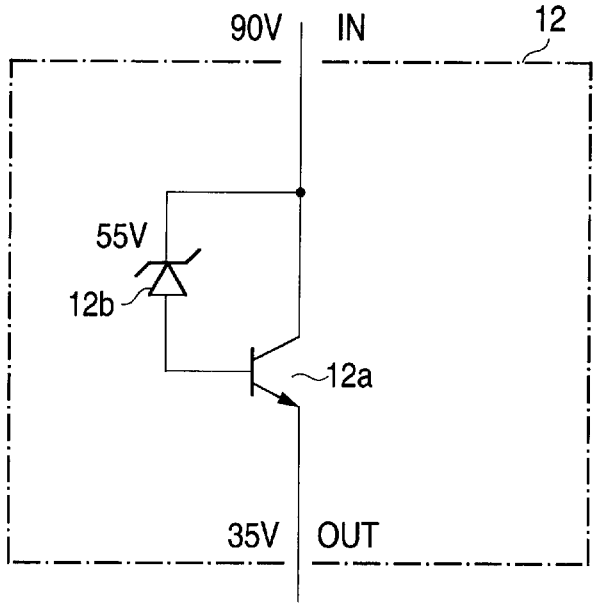
FIG. 7 is a circuit diagram showing a constant voltage dropper according to the third embodiment.

The arrangement of the constant voltage dropper 12 is shown in FIG. 7.

The constant voltage dropper 12 is constituted by a transistor 12*a* and a Zener diode 12*b*. The collector of the transistor 12*a* is connected to the cathode of the Zener diode 12*b*, the base of the transistor 12*a* is connected to the anode of the Zener diode 12*b*, and the emitter (the output end of the constant voltage dropper 12) of the transistor 12*a* is connected to the head driving power source 34. In this embodiment, the Zener voltage of the Zener diode 12*b* is 55V, and the voltage of the head driving power source 34 is 35V. That is, the constant voltage dropper 12 is so designed that a current flows through it when the input voltage is 90V.

Since the processing performed by the constant voltage dropper 12 is fundamentally the same as the constant voltage-input DC/DC converter 2 and the initial voltage charger 4 in the first embodiment, the detailed processing will be described below with reference to FIGS. 3A to 3D used for explaining the voltage absorption of the first embodiment.

While, as is indicated by a chained line in FIG. 3A, it is natural for a pair of the head coil 59 and the head driver transistor 33 to be provided for each of multiple print wires, the processing will be explained for the pair of the head coil 59 and the head driver transistor 33 for one print wire. First, when the head driver transistor 33 is rendered on, the drive current i, which is supplied by the power source Vp in the direction indicated by an arrow, drives the head coil 59.

When the head driver transistor 33 is turned off, the induced electromotive force having the polarities shown in FIG. 3A is generated at the head coil 59, and a high induction voltage is produced. When the induction voltage is 90V, the drive current i flows via the diode 6 to the constant voltage dropper 12, as indicated by an arrow in FIG. 3A. In this manner, power that was supplied to the head coils 59 of multiple print wires when they were turned off is absorbed by the constant voltage dropper 12. The power absorbed by the constant voltage dropper is returned, via the Zener diode 12*b* (for which the Zener voltage is 55V), from the output end of the constant voltage dropper 12 to the head driving power source 34. More specifically, when a voltage of 90V is applied to the input end of the constant voltage dropper 12, the voltage is reduced 55V by the Zener diode 12*b*, and 35V is output by the constant voltage dropper 12 and is returned for reusable power to the head driving power source 34.

The above process will now be explained while referring to FIGS. 3B to 3D.

First, when the head driver transistor 33 is turned on, the drive current i flows from the head driving power source 34, and the power P shown in FIG. 3B is supplied to and drives the head coil 59. Then, when the head driver transistor 33 is turned off, an induced electromotive force having the polarities shown in FIG. 3A is produced at the head coil 59, the collector voltage of the head transistor 33 is raised as is shown in FIG. 3C, and power P1 (right-down hatched portion in FIG. 3B) is supplied from the head coil 59 to the constant voltage dropper 12. The power that is obtained by subtracting, from the power P1, the power that is consumed by the constant voltage drop circuit 55 to reduce the voltage 55V is returned to the head driving power source 34. Therefore, since the head driver transistor 33 can be immediately and completely rendered off, and since the current that flows through the head driver transistor 33 is substantially zero, there is no substantial power loss at the head driver transistor 33, as is shown in FIG. 3D. That is, as is indicated in the right-down hatched portion in FIG. 3B, in this embodiment the power P1 that is to be wasted in the related art, when the head driver transistor 33 is rendered off, can be returned to the power source 34, and can be used again as head driving energy. The heat generated by the transistor 33 is also considerably reduced, so that only a simple cooling countermeasure is required, and the size of the package of a power source can be reduced.

In FIG. 3, the ratio of the power P1 (the right-down hatched portion in FIG. 3B) in the OFF state to the total power P (the left-down hatched portion in FIG. 3B) that flows through the head coil 59, i.e., P1/P, is normally 0.15 to 0.20 (15 to 20%). The ratio of the power consumed by the constant voltage dropper 12 to the power P1 when the head transistor 33 is turned off is (55V/90V)×100=60%. Therefore, when the head transistor 33 is turned off approximately 40% of the power P1 is returned to the head driving power source 34 and is effectively utilized. Thus, the increased power efficiency that the constant voltage dropper 12 makes available can be obtained as follows.

Assume that P denotes the total power P that flows through the head coil 59, P1 denotes the power that flows through the head coil 59 when the head driver transistor 33 is turned off, $E_{in}$, denotes the input voltage for the constant voltage dropper 12 when the head driver transistor 33 is turned off, and $E_{out}$ denotes the reduced voltage that is produced by the constant voltage dropper 12 and returned to the head driving power source 34. Then, the improved power efficiency η that is provided by the constant voltage dropper 12 is represented as follows.

$$\eta=(P1/P)\times(E_{out}/E_{in})\times 100\% \quad (1)$$

Assume that the ratio (P1/P) of the power P1 in the OFF state to the total power P is 0.15, that the input voltage ($E_{in}$) of the constant voltage dropper 12 in the OFF state is 90V, and that the voltage of 90V is reduced 55V by the constant voltage dropper 12, and the remaining voltage of 35V (actually the power that corresponds to 35V) is returned to the head driving power source 34. According to equation (1), the power efficiency is 0.15×(35/90)×100≅6%, and the power efficiency, in other words, can be increased about 6%.

As is described above, according to this embodiment, the power that is accumulated at the head coil 59 when the head driver transistor 33 is turned on is partially consumed by the constant voltage dropper 12 when the transistor 33 is turned off, and the remaining power is returned to the head driving power source 34. Therefore, since the power accumulated at the head coil 59 is not lost due to heat generation at the head driver transistor 33, a part of this power can be effectively used again as energy for driving the head coil. Thus, the efficiency of the head driving power source can be improved.

Further, since heat generated by the head driver transistor 33 is also drastically reduced by this method, only a simple heat sink is required for the transistor 33, and the power source package can be compactly made. Furthermore, since the consumption of power by the head driver transistor 33 can also be reduced, the head can be efficiently driven, and as a result, the entire power supply apparatus can be made compactly.

Figure 8:
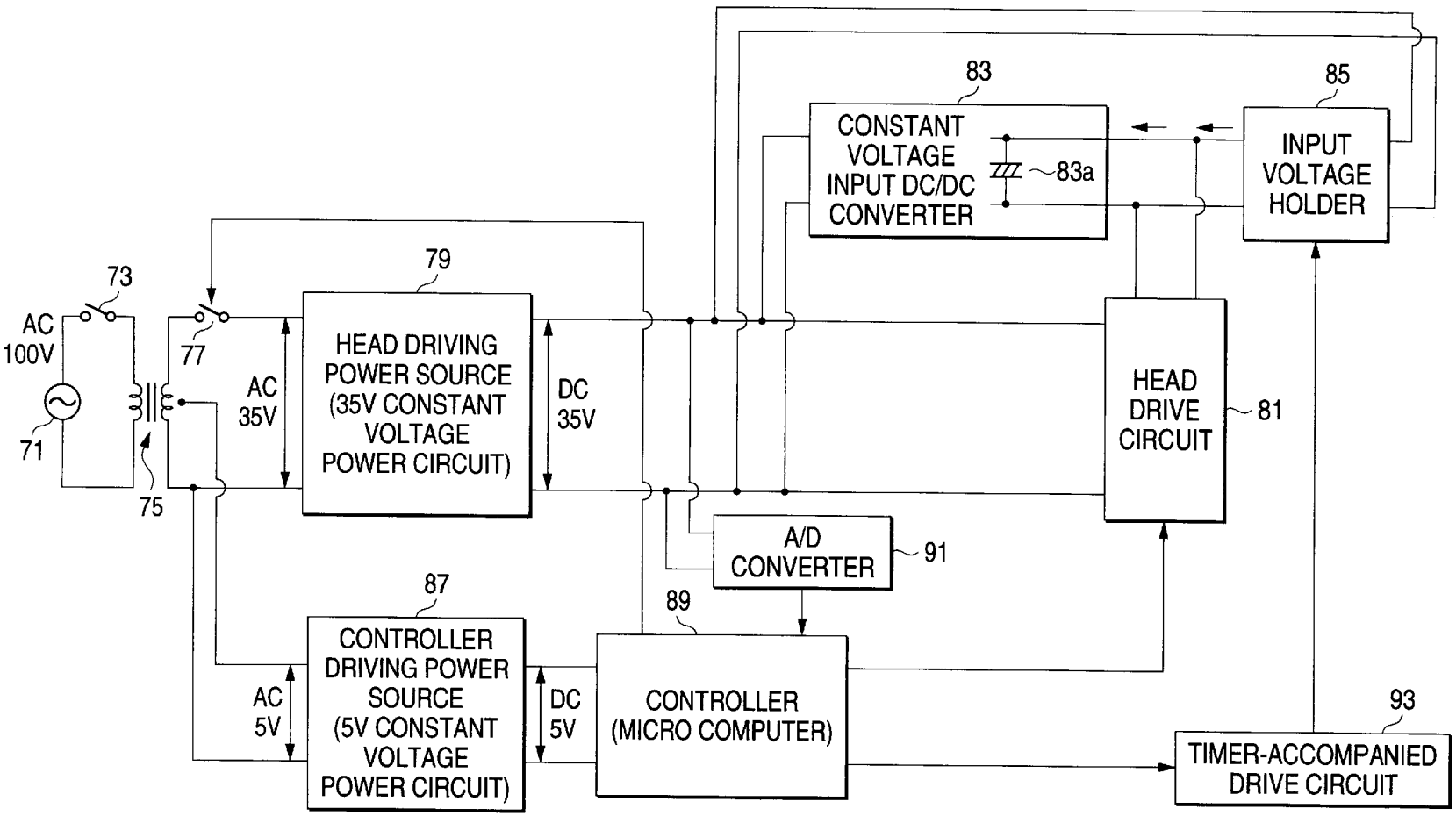
FIG. 8 is a diagram showing the whole arrangement of a head drive circuit according to a fourth embodiment of the invention.

A fourth embodiment of the present invention will now be described with reference to FIGS. 8 to 12. FIG. 8 shows the whole arrangement of a head driving circuit according to this embodiment.

In the circuit according to the embodiment, the back electromotive force of a driving coil of a printing head which has conventionally been wasted can be returned to a head driving power source 79 and can be recycled as the driving energy of a printing head, thereby saving an energy. Detailed description will be given below.

A circuit shown in FIG. 8 comprises a transformer 75, a power saving mode switch 77, the head driving power source (35V constant voltage power circuit) 79, a controller driving power source 87 (5V constant voltage power circuit), an A/D converter 91, a controller (microcomputer) 89, a head drive circuit 81, a timer-accompanied drive circuit 93, an input voltage holder 85, and a constant voltage-input DC/DC converter (hereinafter simply referred to as a DC/DC converter) 83.

The transformer 75 drops a voltage of AC100V to be applied from a main power source 71 through a main power switch 73 and generates voltages of AC35V and AC5V. The voltage AC35V is input to the head driving power source 79 through the power saving mode switch 77 and the voltage of AC5V is input to the controller driving power source 87.

The power saving mode switch 77 is provided between the transformer 75 and the head driving power source 79 and an ON/OFF state is switched by the controller 89. When the power saving mode switch 77 is set in the ON state, the voltage of AC35V applied from the transformer 75 is input to the head driving power source 79. When the power saving mode switch 77 is set in the OFF state, the voltage of AC35V is not input to the head driving power source 79.

The head driving power source 79 converts the input voltage of AC35V applied from the transformer 75 into DC35V and the voltage of DC35V, is input to the head drive circuit 81 and the input voltage holder 85. When the power saving mode switch 77 is set in the OFF state, the voltage of AC35V is not input to the head driving power source 79.

The controller driving power source 87 receives a voltage of AC5V from the transformer 75 irrespective of the ON/OFF state of the power saving mode switch 77 and converts the voltage of AC5V into DC5V to be input to the controller 89.

The A/D converter 91 digitally converts an analog signal output from the head driving power source 79 and informs the controller (microcomputer) 89 of the output voltage value of the head driving power source 79.

The controller 89 controls ON/OFF (activation/deactivation) of a power saving mode. More specifically, when an instruction for executing a power saving mode is received from a user or a printer is not operated for a predetermined time period, the controller 89 turns ON the power saving mode. In other words, when the power saving mode switch 77 is turned OFF and the printer is operated (for example, a printing head is driven) during the execution of the power saving mode, the power saving mode is turned OFF, that is, the power saving mode switch 77 is turned ON.

Moreover, when the output voltage value of the head driving power source 79 which is sent from the A/D converter 91 is DC35V, the controller 89 controls the driving operation of the head drive circuit 81. More specifically, the controller 89 sends, to the head drive circuit 81, a head driving signal having such a short cycle (a high frequency) that the printing wire of the head is not substantially driven when the power source of the printing head is turned ON (that is, when the main power switch 73 of the printer is turned ON or when the main power switch 73 is set in the ON state and the power saving mode is deactivated), in other words, the dummy driving operation of the printing head is performed. As will be described below, consequently, when the power source of the printing head is turned ON, the induced electromotive force of the driving coil of the printing head in the head drive circuit 81 is supplied to a condenser 83*a* of the DC/DC converter 83 and initial charging is performed in the DC/DC converter 83.

Furthermore, when the output voltage value of the head driving power source 79 which is sent from the A/D converter 91 is DC35V, the controller 89 controls the ON/OFF of the timer in the drive circuit 93. More specifically, the controller 89 turns OFF the timer in the drive circuit 93 when the power source of the printing head is turned ON, and turns ON the timer in the drive circuit 93 at a predetermined time point in other cases (for example, at the time of standby during or before printing, that is, when the head driving power source 79 is set in the ON state). As will be described below, therefore, the input voltage holder 85 is intermittently (periodically) driven by the timer-accompanied drive circuit 93 except for the time at which the power source of the printing head is turned ON, a power is intermittently supplied from the input voltage holder 85 to the condenser 83*a* of the DC/DC converter 83, and electric charges discharged from the initially charged condenser 83*a* through a printing operation are supplemented (supplemental charging) in the DC/DC converter 83.

The head drive circuit 81 is driven in response to a head driving signal sent from the controller 89 and the back electromotive force of the driving coil of the printing head is supplied to the condenser 83*a* of the DC/DC converter 83.

The timer-accompanied drive circuit 93 is a timer circuit for determining a periodic time at which the input voltage holder 85 is to be driven, and the ON/OFF state of the timer is switched by the controller 89 as described above. The timer-accompanied drive circuit 93 turns ON the switching element of the input voltage holder 85 when the timer is set in the ON state, and sends a driving signal for turning OFF the switching element of the input voltage holder 85 to the input voltage holder 85 to be driven when the timer is set in the OFF state.

The input voltage holder 85 serves to hold a higher input DC voltage than that in the head driving power source 79. When receiving a holder driving signal from the timer-accompanied drive circuit 93, the input voltage holder 85 supplies the held power to the condenser 83*a* of the DC/DC converter 83.

The DC/DC converter 83 serves to convert an input DC power (the back electromotive force of the driving coil 59 of the printing head) having a higher input voltage than the output voltage of the head driving power source 79 into an output DC power having a voltage which is almost equal to the output voltage of the head driving power source 79, and has the condenser 83*a* for storing a power supplied from the head drive circuit 81 and the input voltage holder 85. The DC/DC converter 83 returns the power stored in the condenser 83*a* to the head driving power source 79. The DC/DC converter 83 can have various structures such as a chopper method utilizing a constant voltage control amplifier or a ringing choke converter.

In the circuit, as described above, when the power source of the head drive circuit 81 is turned ON, that is, the main power switch 73 of the printer is turned ON, and the main power switch 73 is set in the ON state and the power saving mode is deactivated (the power saving mode switch 77 is turned ON), the dummy driving operation of the printing head is performed to initially charge the condenser 83*a* of the DC/DC converter 83. When the power source of the head drive circuit 81 is set in the ON state in the cases other than the initial charging, the condenser 83*a* of the DC/DC converter 83 is intermittently subjected to the supplemental charging by the input voltage holder 85.

The operation for carrying out the initial charging and the supplemental charging will be described below in detail.

Figure 9:
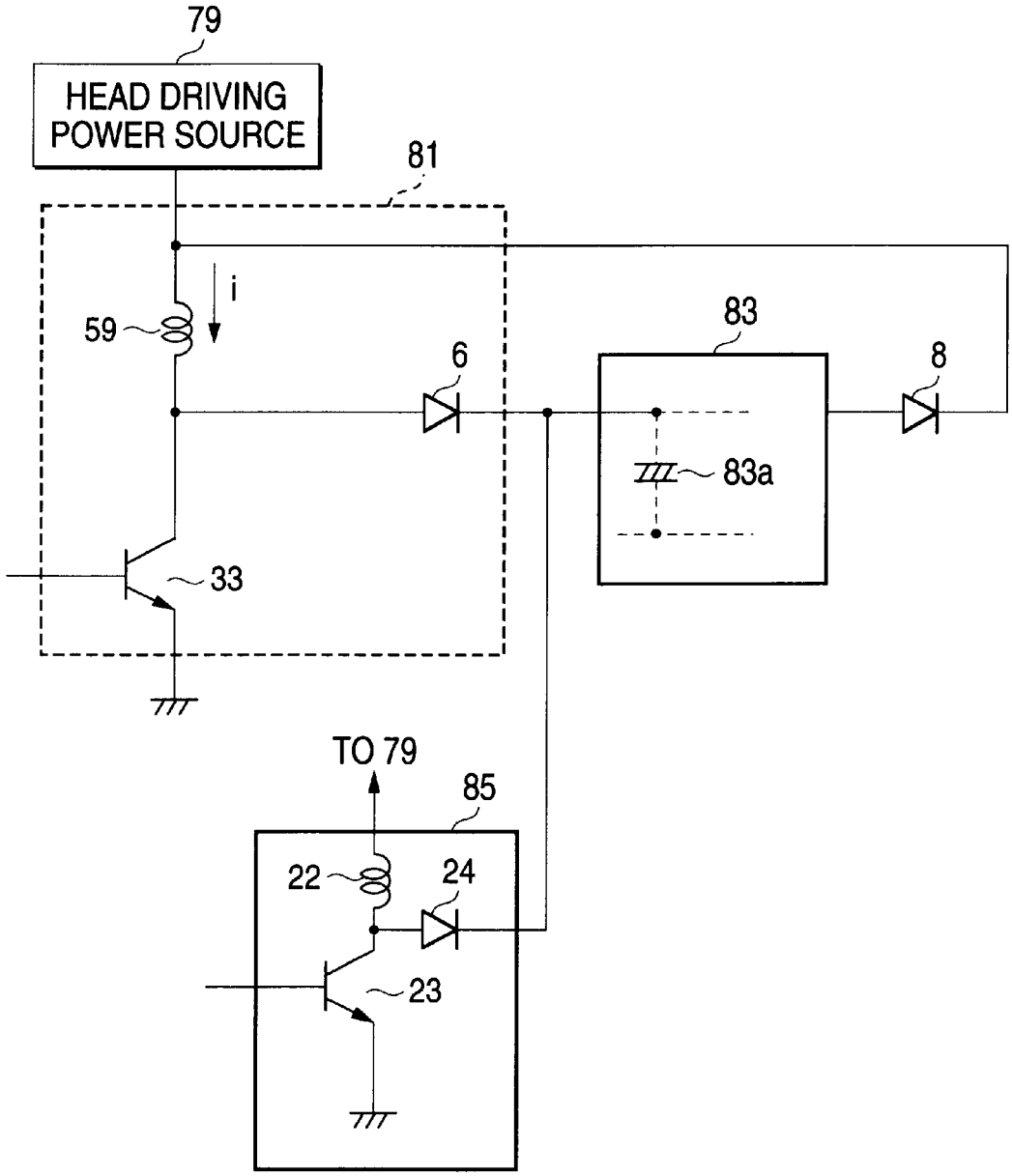
FIG. 9 is a diagram showing the detailed arrangement of the head drive circuit according to the fourth embodiment.

FIG. 9 is a diagram showing the detailed arrangement of the head drive circuit according to the embodiment.

As shown in FIG. 9, the head drive circuit 81 comprises the head coil 59 for driving the printing head, the head driving transistor 33 for driving the head coil 59, and a drive circuit diode 6 for supplying the stored energy of the coil 59 to the DC/DC converter 83 when the head driving transistor 33 is turned OFF and a back electromotive force is generated from the coil 59.

The input voltage holder 85 comprises a charging coil 22 for storing a power supplied from the head driving power source 79, a coil driving transistor 23 for performing a switching operation, and a holder diode 24 for supplying a power stored in the coil 22 to the DC/DC converter 83 when the coil driving transistor 23 is turned OFF.

A charging power supply diode 8 for supplying a power charged by the condenser 83*a* of the DC/DC converter 83 to the head driving power source 79 is provided between the DC/DC converter 83 and the head driving power source 79.

In the drawing, when the power source of the head drive circuit 81 is turned ON, a head driving signal having such a short cycle (a high frequency) that the printing wire of the head is not substantially driven is sent from the controller 89 to the head drive circuit 81 to perform the dummy driving operation of the printing head. More specifically, an ON/OFF pulse having such a high frequency that the printing wire is not operated is applied between the base and the emitter of the head driving transistor 33. Consequently, the head driving transistor 33 repeats the ON/OFF operation quickly and the head coil 59 repeats an operation for storing an energy from the head driving power source 79 and discharging the energy to the condenser 83*a* on the input side of the DC/DC converter 83 to be charged. Consequently, before the printing head (head coil 59) starts an actual print operation, the input voltage of the DC/DC converter 83 (that is, the charging voltage of the condenser 83*a*) has a constant voltage value. Then, a normal print operation is started.

When the head driving transistor 33 of the head drive circuit 81 is turned ON, a driving current i flows from the head driving power source 79 to drive the head coil 59. Then, when the head driving transistor 33 is turned OFF, a high voltage is generated on the collector of the head driving transistor 33 by an induced electromotive force generated on the head coil 59 and is clamped onto the input voltage of the DC/DC converter 83. The driving current i is absorbed into the DC/DC converter 83, and is returned from the output side of the DC/DC converter 83 to the head driving power source 79 through the charging power supply diode 8 and is then recycled.

During a standby state in which the printing is not performed, the charging voltage of the initially charged condenser 83*a* is gradually dropped. Therefore, the condenser 83*a* is intermittently subjected to the supplemental charging. More specifically, after the initial charging, the controller 89 turns ON the timer in the drive circuit 93 and the timer-accompanied drive circuit 93 intermittently drives the input voltage holder 85. Consequently, the coil driving transistor 23 of the input voltage holder 85 intermittently repeats the ON/OFF operation for a predetermined time period and repeats an operation for storing a power supplied from the head driving power source 79 to the charging coil 22 and supplying the stored power to the condenser 83*a* of the DC/DC converter 83, thereby supplementally charging the condenser 83*a* of the DC/DC converter 83. Since a charging current for the supplemental charging may be smaller than that for the initial charging, the current capacity of the input voltage holder 85 may be smaller than that of the head drive circuit.

Figure 10A:
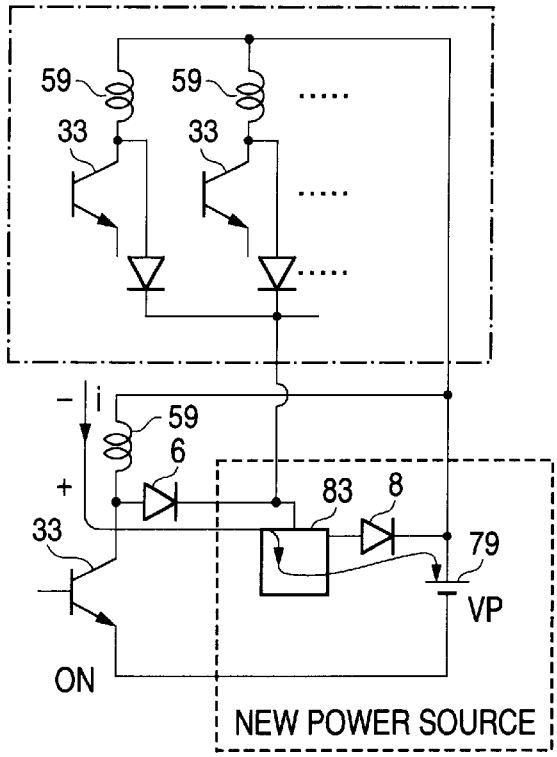
FIGS. 10A to 10D are diagrams for explaining the operation of the head drive circuit according to the first embodiment, with FIG. 10A being a simplified circuit diagram for the head drive circuit of the fourth embodiment.
Figure 10B:
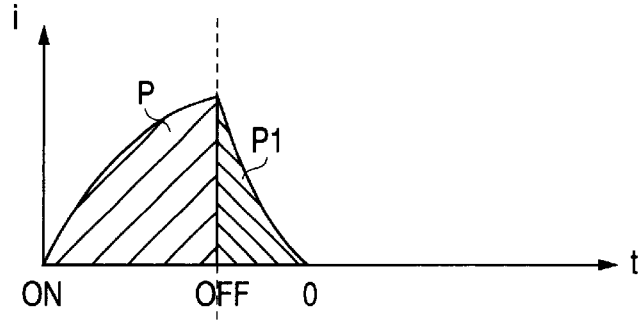
Figure 10C:
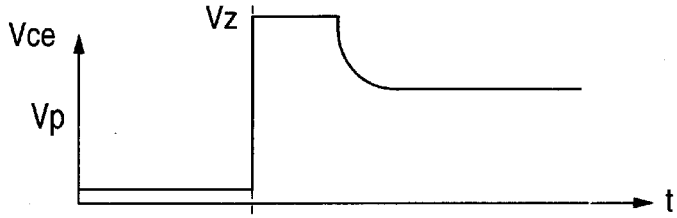
Figure 10D:
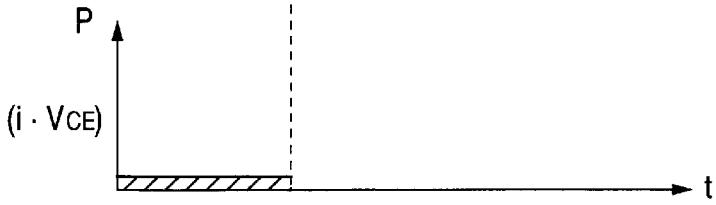

FIG. 10A is a diagram schematically showing the head drive circuit according to this embodiment. FIG. 10B is a waveform diagram showing the driving current i flowing in the head coil 59. FIG. 10C is a waveform diagram showing the collector-emitter voltage of the head driving transistor 33. FIG. 10D is a diagram showing a power loss in the head driving transistor 33. There will be described the operation of the head drive circuit with reference to these figures.

As shown in a chain line in FIG. 10A, it is a matter of course that a set of the head coil 59 and the head driving transistor 33 is present for each of many printing wires. Taking note of the set of the head-coil 59 and the head driving transistor 33 for one printing wire, an operation thereof will be described. First of all, when the head driving transistor 33 is turned ON, the driving current i flows from the power source 79 in the direction of an arrow to drive the head coil 59.

Next, when the head driving transistor 33 is turned OFF, an induced electromotive force is generated on the head coil 59 with a positive or negative polarity shown in the drawing and the diode 6 is conducted with a high induced voltage. Therefore, the collector voltage of the head driving transistor 33 is clamped onto the input voltage of the DC/DC converter 83 as shown in FIG. 10C and the driving current i flows into the input side of the DC/DC converter 83 through the diode 6 as shown in an arrow of FIG. 10A. Thus, a power supplied to the head coil 59 of many printing wires during the OFF state is absorbed into the input side of the DC/DC converter 83. The power thus absorbed is converted into a DC power having a voltage which is substantially equal to a voltage Vp of the head driving power source 79 by the DC/DC converter 83, and is returned from the output side of the DC/DC converter 83 to the head driving power source 79 through the diode 8.

Accordingly, when the head driving transistor 33 is to be turned OFF, the head driving transistor 33 can be completely brought into the OFF state instantaneously. The current flowing to the head driving transistor 33 is substantially zero. As shown in FIG. 10D, therefore, a power loss can be substantially prevented from being generated in the head driving transistor 33. More specifically, as is indicated by the right-down hatching in FIG. 10B, the power P1 has conventionally been wasted when the head driving transistor 33 is turned OFF, while the power can be returned to the head driving power source 79 and can be recycled as a head driving energy in the embodiment. Consequently, the heat generation of the transistor 33 can be decreased considerably. Therefore, a countermeasure to be taken against cooling can be simplified and the size of a package for the power source can be reduced.

While the case in which the head coil 59 and the head driving transistor 33 are constituted in one stage has been described in the embodiment, the invention is not restricted thereto but a head driving transistor in two vertical stages may be used for each of head coils in two vertical stages, for example. With such a circuit structure, the waveform of the driving current is different from the waveform shown in FIG. 10B. Also in this case, the energy conventionally wasted when the transistor is turned OFF can be returned to the head driving power source and can be recycled in the same manner as in the embodiment described above.

The charging operation for the initial charging to be performed in the circuit will be described in detail with reference to the waveform diagram of FIGS. 5A to 5D.

FIGS. 5A and 5B show the operation waveform of the head drive circuit during a print operation. FIG. 5A shows the waveform of a current flowing in the head coil 59 and FIG. 5B shows the waveform of the collector emitter voltage of the head driving transistor 33. On the other hand, FIGS. 5C and 5D show the operation waveform of the head drive circuit 81 during the initial charging, FIG. 5C showing the waveform of an initial charging current flowing in the head coil 59 and FIG. 5D showing the waveform of the collector-emitter voltage of the head driving transistor 33.

In the print operation, the head driving transistor 33 is driven with a pulse having a frequency of approximately 1 to 2 kHz shown in FIG. 5B so that the current shown in FIG. 5A flows to the head coil 59 to drive the printing wire. On the other hand, during the initial charging, the head driving transistor 33 is driven to be turned ON/OFF repeatedly approximately 1000 times over approximately 100 ms with a pulse having a frequency of approximately 10 kHz shown in FIG. 5D (for example, an ON time width of 20 $\mu$s and an OFF time width of 80 $\mu$s). Consequently, a very small pulse current having a short time width shown in FIG. 5C repeatedly flows to the head coil 59 and the printing wire cannot be driven with such a microcurrent having a high frequency. A portion of the microcurrent pulse in which the head driving transistor 33 is turned OFF (that is, a current in a slant line portion of FIG. 5C) flows as a charging current to the condenser 83*a* on the input side of the DC/DC converter 83 through the drive circuit diode 6. When the charging current is caused to repeatedly flow through the switching approximately 1000 times over 100 ms, the charging voltage of the condenser 83*a* reaches a constant value.

The supplemental charging by the input voltage holder 85 during the print operation can also be performed by ON/OFF operating the coil driving transistor 23 with a pulse having the same frequency as that of the initial charging or a pulse having a higher frequency. For example, the charging coil 22 of 3300 $\mu$H is used to drive the coil driving transistor 23 with a pulse having a frequency of 25 kHz and an ON-state period of 3 $\mu$s for each line feed of the print. Thus, the supplemental charging is performed.

As described above, since the input voltage holder 85 carries out only the supplemental charging, a smaller current capacity than that of the head drive circuit is enough. As a variant, however, the initial charging before printing can also be performed through the input voltage holder 85 by increasing the current capacity of the input voltage holder 85 to be at least equal to that of the head drive circuit. Alternatively, the initial charging may be performed by using the head drive circuit and the input voltage holder 85 together.

Next, control flows for the charging operations the condenser 83*a* of the DC/DC converter 83 in the circuit according to the embodiment will be described with reference to FIGS. 11 and 12.

Figure 11:
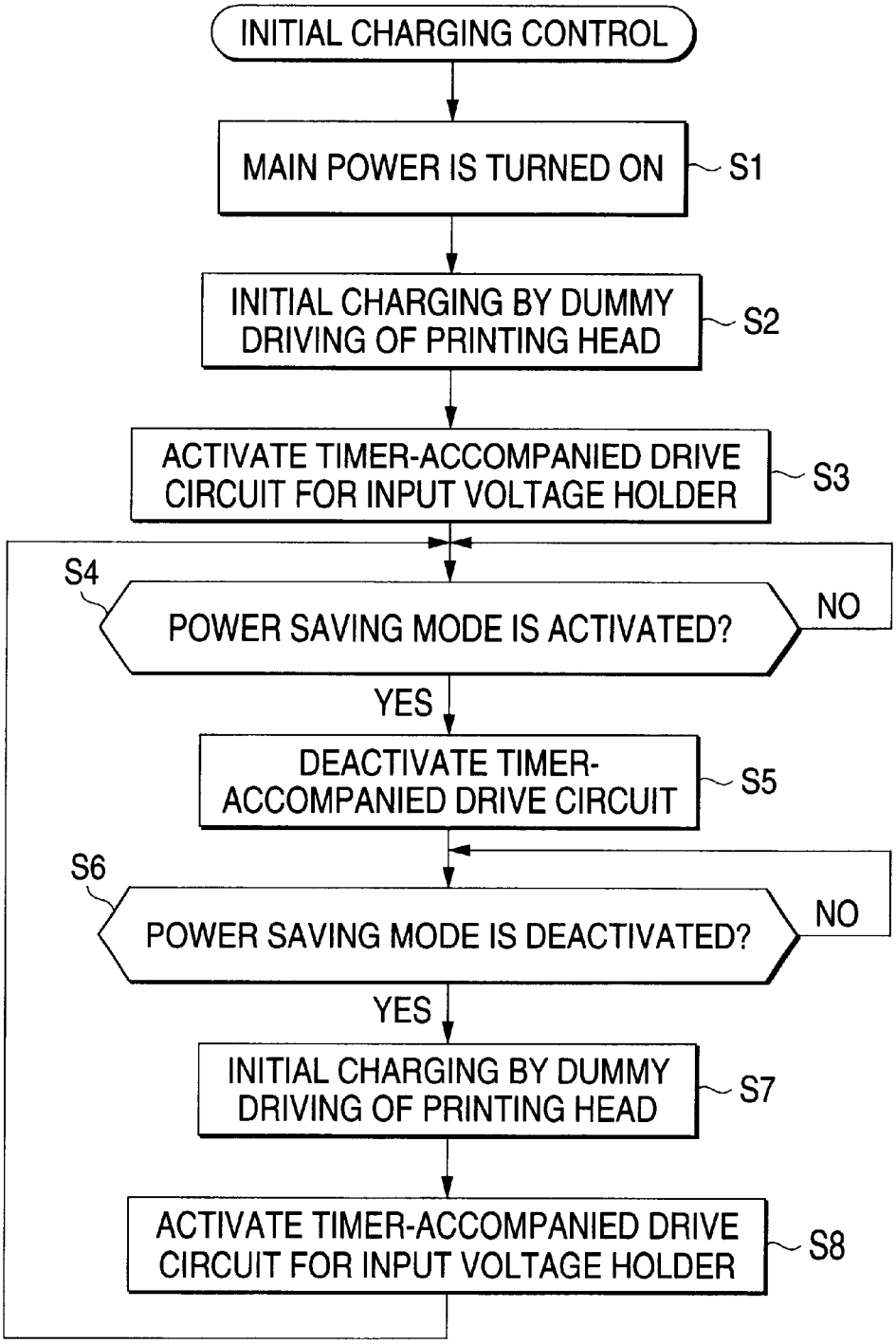
FIG. 11 is a flow chart showing the flow of control for initial charging to an input condenser of a constant voltage-input DC/DC converter.

FIG. 11 is a flow chart showing the control flow of the initial charging for the condenser 83*a* of the DC/DC converter 83.

First of all, when the main power switch 73 of the printer is turned ON (Step S1), the controller 89 sends a head driving signal having a high frequency to the head drive circuit 81 to perform the dummy driving operation of the head drive circuit 81, thereby initially charging the condenser 83*a* of the DC/DC converter 83 (S2). Then, the controller 89 turns ON the timer in the drive circuit 93 to activate the timer-accompanied drive circuit 93 for determining a periodic timing to drive the input voltage holder 85 (S3).

Thereafter, when activating a power saving mode due to the non-operation of the printer for a predetermined time period, that is, turning OFF the power saving mode switch 77 (Y at Step S4), the controller 89 turns OFF the timer in the drive circuit 93 for the input voltage holder 85 and stops the driving operation of the timer-accompanied drive circuit 93 because a voltage output from the head driving power source 79 is eliminated (S5). In other words, when the power saving mode is set, the head drive circuit 81 is not driven. Therefore, since it is not necessary to perform periodic supplemental charging through the input voltage holder 85, the timer in the drive circuit 93 is stopped.

Subsequently, when deactivating the power saving mode, that is, turning ON the power saving mode switch 77 (Y at Step S6), the controller 89 causes the head drive circuit 81 to perform the dummy driving operation of the printing head, thereby initially charging the condenser 83*a* of the DC/DC converter 83 (S7). Then, the timer of the timer drive circuit 93 for the input voltage holder 85 is turned ON to activate the timer-accompanied drive circuit 93 (S8). In other words, the supplemental charging is periodically performed over the condenser 83*a* of the DC/DC converter 83 by periodically driving the input voltage holder 85.

Figure 12:
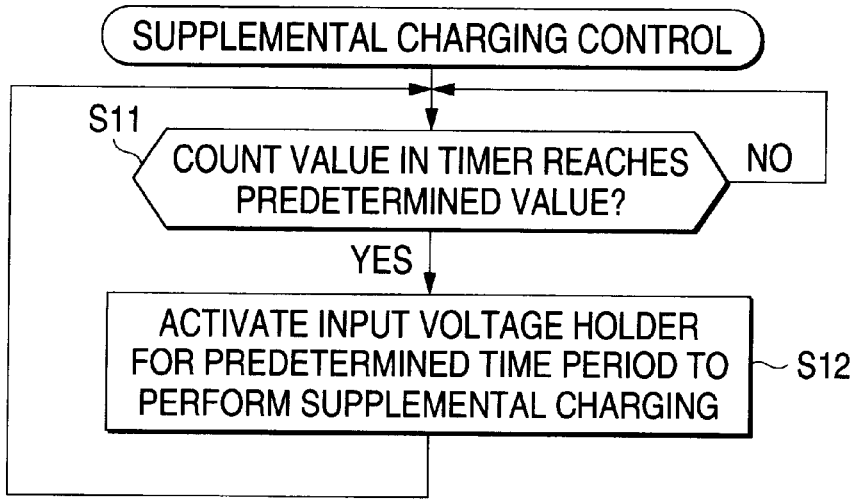
FIG. 12 is a flow chart showing the flow of control for supplemental charging to the input condenser of the constant voltage-input DC/DC converter.
Figure 13:
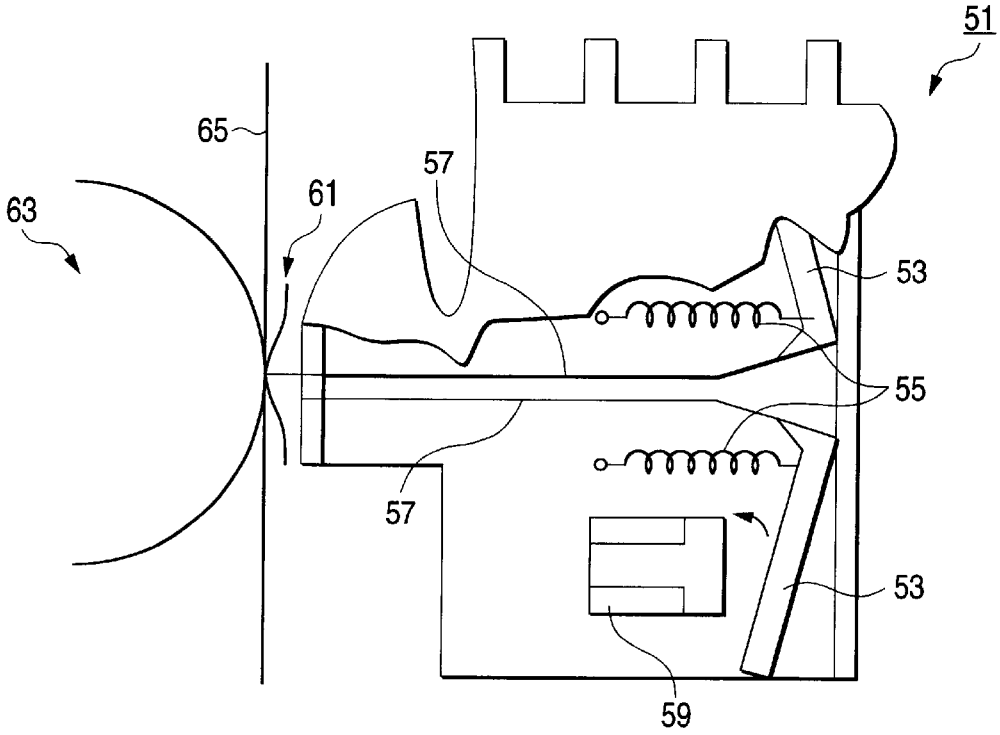
FIG. 13 is a diagram showing an example wire impact print head for the print head of an impact dot printer.
Figure 14:
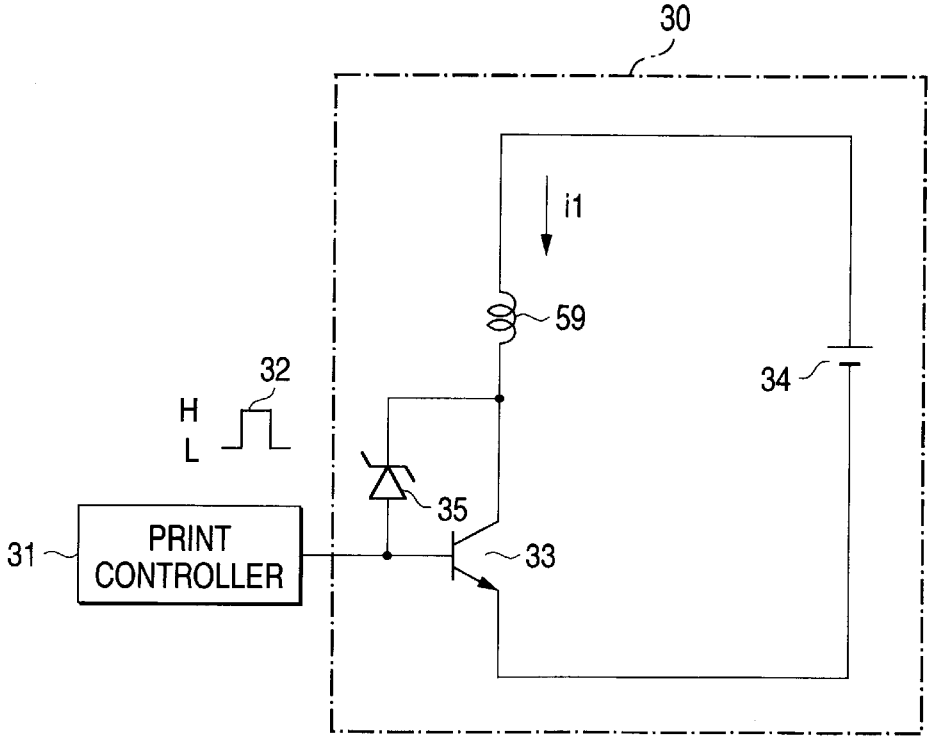
FIG. 14 is a diagram showing an example arrangement of a related head drive circuit.
Figure 15A:
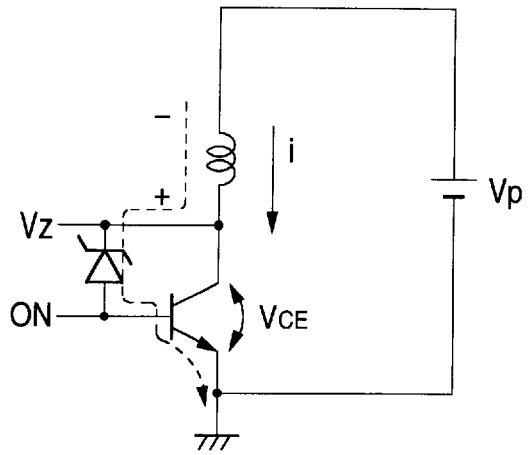
FIGS. 15A to 15D are diagrams for explaining the operation of the related head drive circuit, with FIG. 15A being a simplified circuit diagram for the related head drive circuit.
Figure 15B:
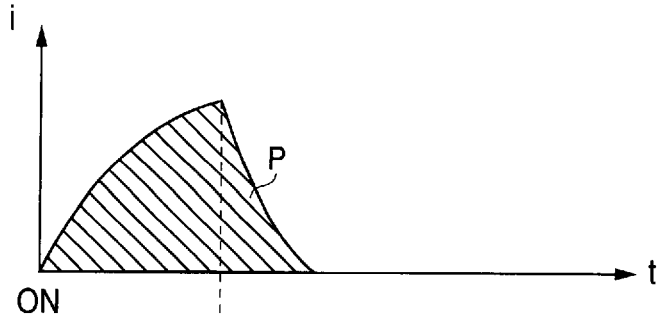
Figure 15C:
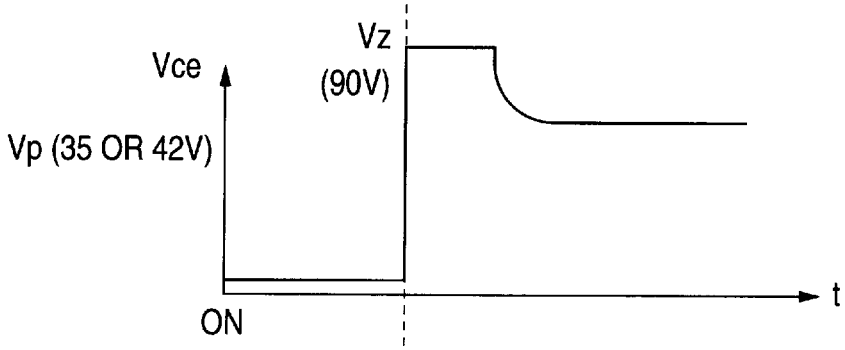
Figure 15D:
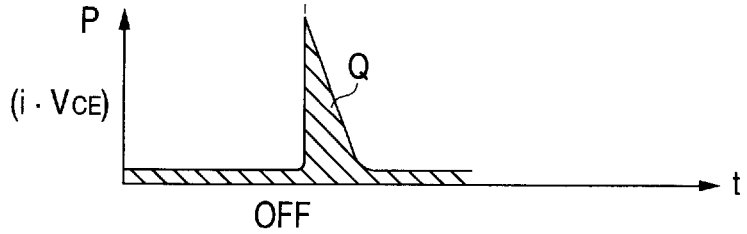

FIG. 12 is a flow chart showing the flow of the control of the supplemental charging over the condenser 83*a* of the DC/DC converter 83.

When the timer is turned ON and activated by the controller 89 and the count value of the timer reaches a predetermined value (Y at Step S11), the timer-accompanied drive circuit 93 operates the input voltage holder 85 for a predetermined time period to perform the supplemental charging over the condenser 83*a* of the DC/DC converter 83 (S12). In other words, the timer-accompanied drive circuit 93 repeats the turn ON/OFF of the coil driving transistor 23 of the input voltage holder 85 for a predetermined time period, thereby repeating the storage of a power in the charging coil 22 and the supply of the stored power to the condenser 83*a* so that the condenser 83*a* is subjected to the supplemental charging.

According to the embodiment, when turning OFF the head driving transistor 33 in the head drive circuit 81, the power stored in the head coil 59 is charged into the DC/DC converter 83, and is then returned to the head driving power source 79 by the DC/DC converter 83 and is effectively recycled for driving the head coil. Consequently, the energy saving of the printer can be realized.

In the charging in the DC/DC converter 83, moreover, the initial charging before printing is performed by the dummy driving operation of the printing head and the supplemental charging for supplementing a decrease in a charging energy during standby in which the printing is not performed is intermittently performed by the input voltage holder 85. Thus, since the power supplied from the head driving power source 79 is efficiently utilized to perform the charging, the energy saving can be realized more effectively. Furthermore, since the input voltage holder 85 performs only the supplemental charging, a smaller current capacity than that of the head drive circuit 81 is enough. Therefore, the cost of an energy saving printer can be reduced.

Although the present invention has been shown and described with reference to specific preferred embodiments, various changes and modifications will be apparent to those skilled in the art from the teachings herein. Such changes and modifications as are obvious are deemed to come within the spirit, scope and contemplation of the invention as defined in the appended claims.

What is claimed is:

1. A head drive circuit for an impact dot printer which performs printing by driving a print wire, comprising:

a DC power source for supplying a power source voltage;

a head coil;

a switching element which is on/off controlled to apply the power source voltage to the head coil for a predetermined time period;

a voltage regulator for converting an input voltage having a value higher than the power source voltage into an output voltage having a value as substantially same as the power source voltage;

a voltage introducer for inputting an inductive voltage, generated in the head coil when the switching element is turned off, into the voltage regulator as the input voltage;

a voltage returner for feeding back the output voltage of the voltage regulator to the DC power source;

a charger, which performs a first charging operation in which a condenser provided with the voltage regulator is initially charged when the DC power source is turned on, and a second charging operation in which the condenser is supplementally charged while the DC power source is turned on, wherein the condenser smoothes the input voltage of the voltage regulator, and a power saving mode in which the DC power source is temporarily turned off even though a main power for the impact dot printer is turned on, wherein the charger charges the condenser when the main power is turned on, and when the power saving mode is deactivated while the main power is turned on.

2. A head drive circuit for an impact dot printer which performs printing by driving a print wire, comprising:

a DC power source for supplying a power source voltage;

a head coil;

a switching element which is on/off controlled to apply the power source voltage to the head coil for a predetermined time period;

a voltage regulator for converting an input voltage having a value higher than the power source voltage into an output voltage having a value as substantially same as the power source voltage;

a voltage introducer for inputting an inductive voltage, generated in the head coil when the switching element is turned off, into the voltage regulator as the input voltage; and a voltage returner for feeding back the output voltage of the voltage regulator to the DC power source, and a charger, which performs a first charging operation in which a condenser provided with the voltage regulator is initially charged when the DC power source is turned on, and a second charging operation in which the condenser is supplementally charged while the DC power source is turned on, wherein the condenser smoothes the input voltage of the voltage regulator, wherein the charger turns on/off the switching element repetitively at a frequency which is too high to drive the print wire, so that an inductive voltage generated in the head coil is charged to the condenser every time when the switching element is turned off, in the first charging operation.

3. A head drive circuit for an impact dot printer which performs printing by driving a print wire, comprising:

a DC power source for supplying a power source voltage;

a head coil;

a switching element which is on/off controlled to apply the power source voltage to the head coil for a predetermined time period;

a voltage regulator for converting an input voltage having a value higher than the power source voltage into an output voltage having a value as substantially same as the power source voltage;

a voltage introducer for inputting an inductive voltage, generated in the head coil when the switching element is turned off, into the voltage regulator as the input voltage; and a voltage returner for feeding back the output voltage of the voltage regulator to the DC power source, and a charger, which performs a first charging operation in which a condenser provided with the voltage regulator is initially charged when the DC power source is turned on, and a second charging operation in which the condenser is supplementally charged while the DC power source is turned on, wherein the condenser smoothes the input voltage of the voltage regulator, wherein:

the charger includes: a charging coil; a coil switching element which determines whether the power source voltage of the DC power source is supplied to the charging coil; and an input voltage holder which applies an inductive voltage generated in the charging coil when the coil switching element is turned off to the condenser; and the charger turns on/off the coil switching element repetitively, so that the inductive voltage generated in the charging coil is repetitively charged to the condenser every time when the coil switching element is turned off, in the second charging operation.

4. A head drive circuit for an impact dot printer which performs printing by driving a print wire, comprising:

a DC power source for supplying a power source voltage;

a head coil;

a switching element which is on/off controlled to apply the power source voltage to the head coil for a predetermined time period;

a voltage regulator for converting an input voltage having a value higher than the power source voltage into an output voltage having a value as substantially same as the power source voltage;

a voltage introducer for inputting an inductive voltage, generated in the head coil when the switching element is turned off, into the voltage regulator as the input voltage; and a voltage returner for feeding back the output voltage of the voltage regulator to the DC power source, and a charger, which performs a first charging operation in which a condenser provided with the voltage regulator is initially charged when the DC power source is turned on, and a second charging operation in which the condenser is supplementally charged while the DC power source is turned on, wherein the condenser smoothes the input voltage of the voltage regulator, wherein the charger performs the second charging operation periodically.

5. A head drive circuit for an impact dot printer, comprising:

a DC power source;

a voltage regulator for converting an input voltage into an output voltage, wherein the output voltage, that has a value substantially the same as the DC power source, is fed back to the DC power source;

a charger that provides the input voltage at a predetermined value to the voltage regulator;

wherein the DC power source supplies a power source voltage at least for the charger; and a power saving mode in which the DC power source is turned off even though a main power for the impact dot printer is turned on, wherein the charger provides the input voltage to the voltage regulator when the main power for the impact dot printer is turned on, and when the power saving mode is deactivated.

* * * * *